US006723007B1

(12) United States Patent
Chao

(10) Patent No.: US 6,723,007 B1
(45) Date of Patent: Apr. 20, 2004

(54) FACE OF A GOLF CLUB HEAD

(75) Inventor: Chih-Yeh Chao, Pingtung (TW)

(73) Assignee: O-Ta Precision Casting Co., Ltd., Pingtung Hsien (TW)

( * ) Notice: Subject to any disclaimer, the term of this patent is extended or adjusted under 35 U.S.C. 154(b) by 0 days.

(21) Appl. No.: 10/314,122

(22) Filed: Dec. 9, 2002

(51) Int. Cl.[7] ..... A63B 53/04
(52) U.S. Cl. ..... 473/342; 473/345; 473/349
(58) Field of Search ..... 473/324, 342, 473/345, 346, 329, 332, 349, 347, 348, 350

(56) References Cited

U.S. PATENT DOCUMENTS 3,695,618 A * 10/1972 Woolley et al. ..... 473/342
5,377,986 A * 1/1995 Viollaz et al. ..... 473/330
5,425,538 A * 6/1995 Vincent et al. ..... 473/342
5,431,396 A * 7/1995 Shieh ..... 473/329
5,447,311 A * 9/1995 Viollaz et al. ..... 473/342
5,497,993 A * 3/1996 Shan ..... 473/329
5,620,382 A * 4/1997 Cho et al. ..... 473/331
6,093,116 A * 7/2000 Hettinger et al. ..... 473/332

* cited by examiner

*Primary Examiner*—Sebastiano Passaniti
(74) *Attorney, Agent, or Firm*—Rosenberg, Klein & Lee

(57) ABSTRACT

A face of a golf club head includes a recess defined in the face and a striking pad mounted in the recess. The striking pad is a combination of a high-strength alloy, such as titanium alloy, Fe-Al-Mn alloy steel, marging stainless steel or precipitated stainless steel, and a ceramic or carbides filler, such as the $Al_2O_3$, $SiO_2$, TiC, WC. etc., so the striking pad has an excellent reactive force when striking a golf ball and good control of the direction of the golf ball.

1 Claim, 4 Drawing Sheets

| NO | MATERIAL OF THE FACE | MATERIAL OF THE BODY | THICKNESS OF THE FACE(mm) | THICKNESS OF THE CERAMIC TAYER(mm) | COFFICIENT OF RESPONSE |
|---|---|---|---|---|---|
| 1 | 6-4 Ti | 450 SS | 2.70~2.80 | — | 0.810 |
| 2 | 6-4 Ti+$Al_2O_3$ (0.3 μm) | 450 SS | 2.70~2.80 | 1.0±0.05 | 0.822 |
| 3 | 6-4 Ti+$Al_2O_3$ (0.05 μm) | 450 SS | 2.70~2.80 | 1.0±0.05 | 0.835 |
| 4 | 6-4 Ti+$SiO_2$ (5 μm) | 450 SS | 2.70~2.80 | 1.0±0.05 | 0.821 |
| 5 | 6-4 Ti+TiC (5 μm) | 450 SS | 2.70~2.80 | 1.0±0.05 | 0.831 |
| 6 | 6-4 Ti+WC (5 μm) | 450 SS | 2.70~2.80 | 1.0±0.05 | 0.839 |

FIG.3

FACE OF A GOLF CLUB HEAD

BACKGROUND OF THE INVENTION

1. Field of the Invention

The present invention relates to a face of a golf club head, and more particularly to a face of a golf club head, which is made of two different materials.

2. Description of Related Art

Three types of golf clubs are commonly used in a game of golf, a putter, irons (#3–#9, PW, S etc.) and wood clubs (#1–#7). Each type of clubs is designed to correspond to a certain field condition and a particular distance.

The wood club originally has a wooden club head and is designed to hit a ball far but recently. It has become popular for the wood club head to be made of metal or alloy to provide high rigidity and longer trajectory distance. With reference to FIG. 4, a conventional head of a golf club in accordance with the prior art comprises a body (30) and a face (31). The body (30) has a top called a crown, a bottom called a sole, a front, a rear and a shank. The face (31) is attached to the front of the head (30) to strike a golf ball. For decreasing the missing hit and for increasing the sweet spot, the face of a golf club head is usually made of a high strength metal such as precipitation-hardening stainless steel (17-4PH, SS431), maraging stainless steel (455SS, 465SS), a titanium alloy (6-4 Ti, SP700, 15-3-3-3, 10-2-3, etc.) or other metallic material. In addition, for increasing the distance of golf ball trajectory, the face has a coating (not shown) applied by TiN, TiCN, or diamond films using the PVD/CVD. Consequently, the conventional face of a golf club head has a high-strength core and hard surface to control the golf ball and promote the reactive force when striking a golf ball.

However, the structure of the conventional face of a golf club head is not strong enough to provide the best response of impact coefficient. Moreover, in accordance with the pursuit of the high strength for the golf club head, it is short that the time of the golf ball impact to the face of golf head, and resulted in the lower control of the golf head in the meantime, the structure of the conventional face of a golf head is not flexible enough to provide the best control to the direction of the golf ball. The golf club head needs to be advantageously altered.

The present invention has arisen to mitigate and/or obviate the disadvantages of the conventional face of a golf club head.

SUMMARY OF THE INVENTION

The main objective of the present invention is to provide an improved face for a golf club head and that provides both of the higher surface hardness and the suitable flex.

To achieve the objective, the face of a golf club head in accordance with the present invention comprises a recess defined in the face and a striking pad mounted in the recess. The strike pad is a combination of high-strength alloy and ceramic material to provide the best reactive force, response of coefficient and suitable impact time to be resulted in an excellent control of the direction of the golf ball and to prolong the distance of the ball trajectory.

Further benefits and advantages of the present invention will become apparent after a careful reading of the detailed description with appropriate reference to the accompanying drawings.

BRIEF DESCRIPTION OF THE DRAWINGS

FIG. 3 is a Coefficient-Of-Response (COR) examination in accordance with the present.

DETAILED DESCRIPTION OF THE INVENTION

Figure 1:
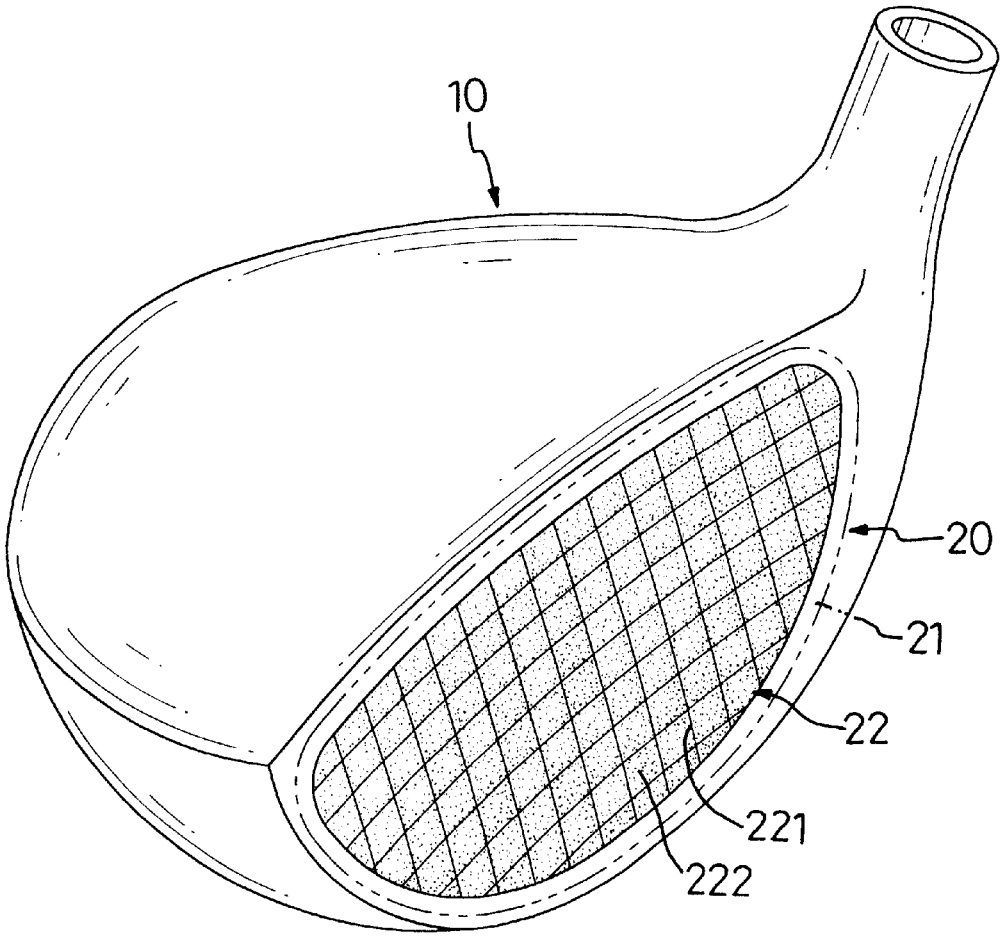
FIG. 1 is a perspective view of a golf club head with a face in accordance with the present invention.
Figure 2:
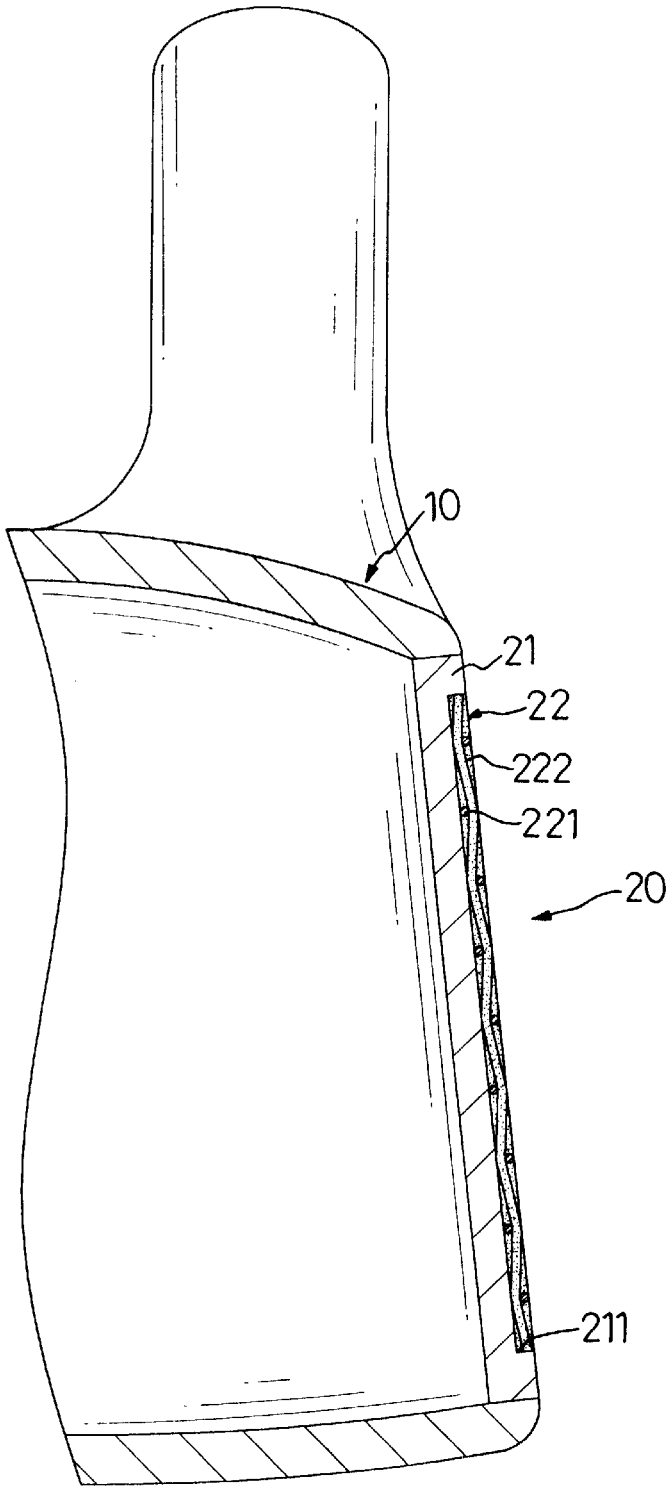
FIG. 2 is a cross sectional side plan view of the face of the golf club head in FIG. 1.
Figure 4:
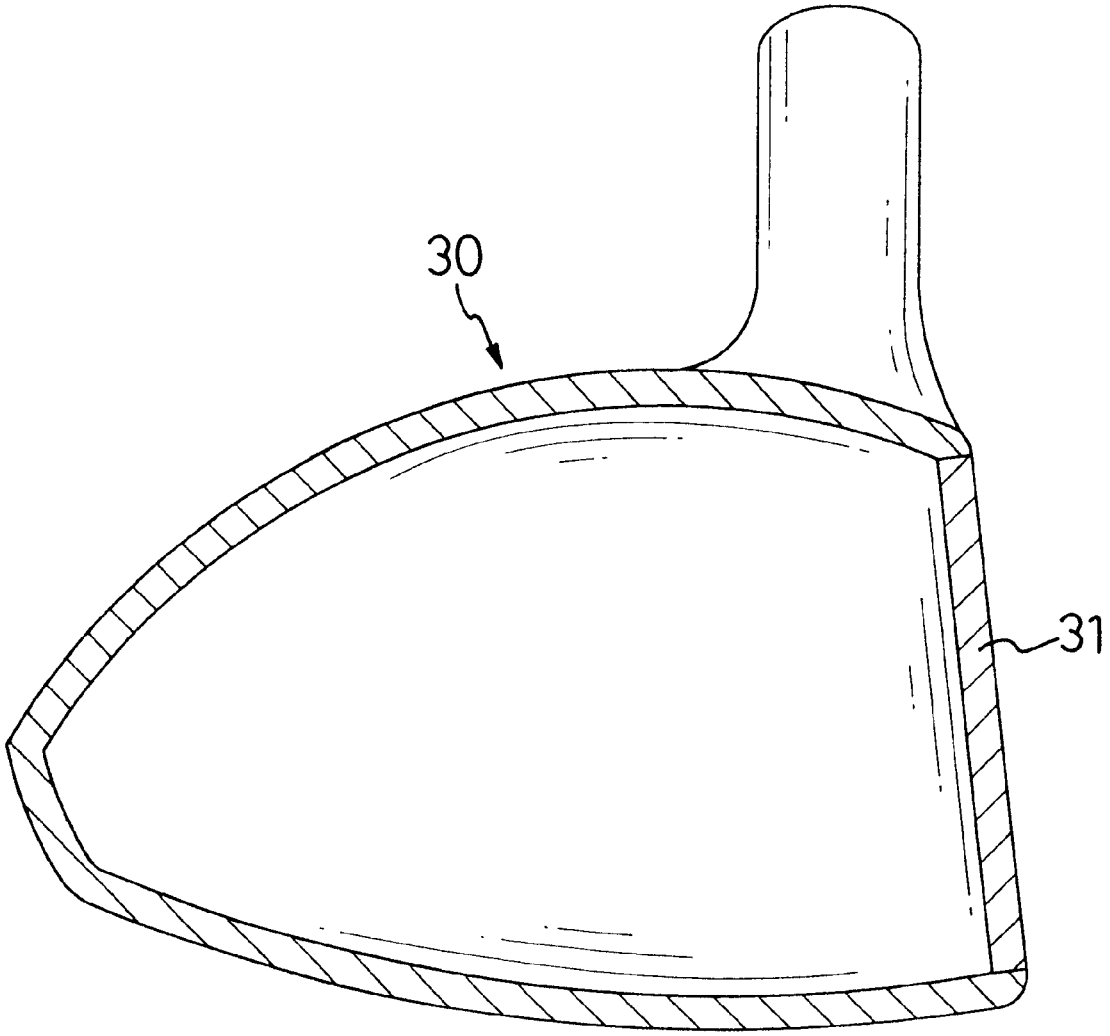
FIG.4 PRIOR ART
FIG. 4 is a cross sectional side plan view of a golf club head with a conventional face in accordance with the prior art.

With reference to the drawings and initially to FIGS. 1 and 2, a face (20) of a golf club head (10) in accordance with the present invention is adapted to be securely attached to a head (10) of a golf club. The face (20) comprises a face cover (21) and a striking pad (22). A recess (211) is defined in the face cover (21). The striking pad (22) is securely mounted in the recess (211). The striking pad (22) is a combination of high-strength metal (221) and filler (222).

The high-strength metal (221) is essentially titanium alloy, Fe-Al-Mn alloy steel, maraging stainless steel or precipitated stainless steel and is formed into a net (not A numbered ) that has multiple vertical ribs (not numbered) and horizontal ribs (not numbered). The vertical ribs and the horizontal ribs are interlaced with each other and the filler is ceramic material or carbides material. Similar to the powder metallurgy technology, the filler (222), such as the $Al_2O_3$, $SiO_2$, Tic, WC etc., powders are pressed under 50 to 100 tons force into the face (21) and sintered at about 900 to 1300° C. for various times. And then, the composited face is welded with the body to form the golf club head.

The filler (222) is essentially a hard material and provide the striking pad (22) a best reaction force and an excellent response of coefficient of the golf head. In addition, the embrittlement of the filler (222) could be inhibited in accordance with the high-strength metal (221) net. Moreover, because the thinner face base (21) can also provide the more flex to the golf head face (21), the control of the direction of the golf ball is excellent. Base on the COR examinations, with reference to FIG. 3, it is found that the golf head in accordance with the present can provide higher COR values. It is imply that the golf club head in accordance with the present invention are strong enough to provide an excellent reactive force and the ball trajectory of distance is prolonged when striking a golf ball.

Although the invention has been explained in relation to its preferred embodiment, it is to be understood that many other possible modifications and variations can be made without departing from the spirit and scope of the invention as hereinafter claimed.

What is claimed is:

1. A face of a golf club head, comprising:

a face cover adapted to be mounted on a golf club head;

a recess defined in the face cover and a striking pad mounted in the recess to form an exposed striking face on the face cover, where the striking pad is a combination of a high-strength metal net and a hard filler material;

wherein the high-strength metal net is made of materials selected from the group consisting of titanium alloy, Fe-Al-Mn alloy steel, maraging stainless steel and precipitated stainless steel, and the hard filler is formed of a sintered composition of a compressed powdered material selected from the group consisting of ceramic and carbide materials.

* * * * *